US006454375B2

(12) United States Patent
Wilson et al.

(10) Patent No.: US 6,454,375 B2
(45) Date of Patent: Sep. 24, 2002

(54) PRESSURE BASED INK LEVEL DETECTOR AND METHOD

(75) Inventors: Rhonda L. Wilson, Monmouth; Jeffrey L. Thielman, Corvallis, both of OR (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/888,716

(22) Filed: Jun. 25, 2001

Related U.S. Application Data

(63) Continuation-in-part of application No. 09/145,199, filed on Sep. 1, 1998, now abandoned.

(51) Int. Cl.[7] ..... B41J 2/195; B41J 2/175
(52) U.S. Cl. ..... 347/7; 347/85
(58) Field of Search ..... 347/5, 6, 7, 19, 347/84, 85, 89

(56) References Cited

U.S. PATENT DOCUMENTS

| | | | | | |
|---|---|---|---|---|---|
| 4,038,650 | A | | 7/1977 | Evans et al. | 340/244 R |
| 4,544,840 | A | | 10/1985 | Keller | 250/227 |
| 4,587,535 | A | * | 5/1986 | Watanabe | 347/7 |
| 4,604,633 | A | | 8/1986 | Kimura et al. | 346/140 R |
| 4,639,738 | A | * | 1/1987 | Young et al. | 346/75 |
| 4,973,993 | A | | 11/1990 | Allen | 346/140 R |
| 4,977,413 | A | | 12/1990 | Yamanaka et al. | 346/140 R |
| 5,583,545 | A | | 12/1996 | Pawlowski, Jr. et al. | 347/7 |
| 5,583,547 | A | * | 12/1996 | Gast et al. | 347/7 |
| 5,729,256 | A | | 3/1998 | Yamanaka et al. | 347/7 |

FOREIGN PATENT DOCUMENTS

| | | | | |
|---|---|---|---|---|
| EP | 0405555 A2 | | 1/1991 | B41J/2/175 |
| EP | 0405555 A2 | * | 1/1991 | 347/7 |
| EP | 0547182 A2 | | 5/1993 | B41J/2/175 |
| EP | 0840098 A2 | | 5/1998 | G01F/23/14 |
| JP | 0055073564 | | 6/1980 | B41J/3/04 |
| JP | 60024954 | | 2/1985 | B41J/3/04 |
| JP | 1237148 | | 9/1989 | B41J/3/04 |

* cited by examiner

*Primary Examiner*—John Barlow
*Assistant Examiner*—An H. Do

(57) ABSTRACT

An apparatus and method for measuring an approximate volume of ink remaining in a flexible bag ink supply. A signal is generated from the pressure applied to an ink supply to force ink out of the bag and the pressure of ink expelled from that ink supply. A predictable relationship is disclosed that permits an approximate volume of remaining ink to be determined based on the differential pressure signal. The use of drop counting in combination with pressure measuring is also disclosed. The apparatus and method is also applicable to non-pressurized in supplies.

17 Claims, 2 Drawing Sheets

PRESSURE BASED INK LEVEL DETECTOR AND METHOD

RELATED APPLICATIONS

"This application is a continuation-in-part of U.S. patent application Ser. No. 09/145,199, PRESSURE BASED INK LEVEL DETECTOR AND METHOD, filed Sep. 1, 1998, which has been abandoned".

FIELD OF THE INVENTION

The present invention relates to the detection of ink level in printers and plotters and like mechanisms and, more specifically, to the detection of an ink out or nearing an ink out condition in a printer or plotter.

BACKGROUND OF THE INVENTION

Several printer and plotter arrangements are known in the art. Each of these arrangements provide some type of print head that is coupled to an ink supply. The ink supply may be formed integrally with the print head or be detachably coupled thereto. Manufacturers of prior art printers and plotters include Hewlett-Packard, Canon and Epson, amongst others. In the text that follows, the terms printer and plotter are referred to collectively with the term printer.

Some prior art printers have an ink level or ink out detection mechanism. Printer ink level detection mechanisms are known that utilize mechanical, electrical, optical and pressure based detecting techniques. While beneficial in providing some degree of ink level indication, these prior art detection mechanisms tend to be disadvantageous for one or more of the following reasons: (1) they are not accurate enough at low ink volume, causing a manufacturer to put more ink in a cartridge to accommodate for measurement errors; (2) they are undesirably expensive; (3) they are not capable of functioning properly with higher performance printers; and (4) the detecting sensors are coupled directly to or otherwise provided with the ink cartridges such that the sensors are discarded along with spent ink cartridges.

SUMMARY OF THE INVENTION

Accordingly, embodiments of the present invention comprise ink level detection mechanisms and methods that utilize the pressure effects of a collapsing ink bag to detect and quantify a near out of ink condition.

It is another object of the present invention to provide an ink level detection device that is relatively economical to manufacture and operate.

It is another object of the present invention to provide an ink level detection device that may be implemented separately from an ink supply for which it detects ink volume level.

It is also an object of the present invention to provide an ink level detection device that maximizes the amount of usable ink (i.e., decreases wasted ink) by increasing the accuracy with which on out of ink condition is determined.

These and related objects of the present invention are achieved by use of a pressure based ink out detector as described herein.

The attainment of the foregoing and related advantages and features of the invention should be more readily apparent to those skilled in the art, after review of the following more detailed description of the invention taken together with the drawings.

DETAILED DESCRIPTION

Figure 1:
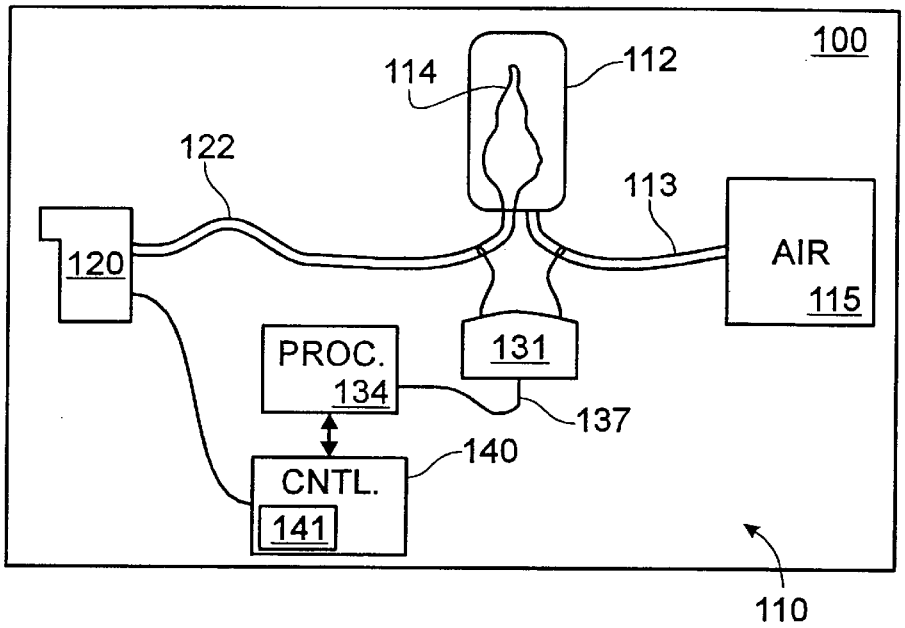
FIG. 1 is a diagram of an ink level detection arrangement in accordance with the present invention.

Referring to FIG. 1, a diagram of a printer 100 having an ink level detection arrangement 110 in accordance with the present invention is shown. Printer 100 includes an ink supply container 112 preferably having a collapsible ink bag 114 located therein, an air supply tube 113, an air pressure source 115, an ink supply tube 122, a differential or relative pressure sensor 131, an ink level processing circuit 134, a print head 120 (with an ink expulsion mechanism) and a control circuit 140 that preferably includes an ink drop counting mechanism 141. The present invention determines ink volume level by measuring pressure within ink supply tube 122. The measured pressure corresponds to an approximate ink volume level as discussed below with reference to FIG. 2. A benefit of this approach, amongst others, is that the pressure of ink within the supply tube is a true measure of the availability of ink for printing.

In a first preferred embodiment of the present invention, a differential pressure sensor 131 is coupled to both air supply tube 113 and ink supply tube 122. A suitable differential pressure sensor includes the wet-wet differential pressure transducer made by Omega Engineering as well as other commercially available differential pressure sensors.

Since the air pressure on bag 114 causes ink to be expelled into tube 122, increases and decreases in air pressure result in similar increases and decreases in ink pressure. Use of a differential sensor compensates for ink pressure changes that are caused by air pressure fluctuations and also permits use of a non-constant air supply pressure. Alternatively, arrangements that utilize an air pressure regulator and an absolute sensor, or multiple absolute sensors or the like are contemplated by the inventors and are discussed in more detail below with reference to FIG. 3. It should be recognized that the amount of pressure exerted by the ink is also to some extent dependent on the height of bag 114 above sensor 131. As the height of the ink over sensor 131 increases, the weight or pressure of the ink at transducer 131 increases.

Processing circuit 134 is connected to transducer 131 via line 137. The processing circuit 134 may include circuitry such as an on-board calibration EPROM that compensates for sensor drift and other circuitry such as an amplifier, filter and an analog to digital converter. Processing circuit 134 is preferably coupled to control logic 140. Control logic 140 preferably includes firmware for processing sensor output signals and determining approximate volume and almost out-of-ink and out-of-ink condition therefrom. Control logic 140 also includes drop counting mechanism or logic 141. This logic preferably performs a count of a number of fire signals propagated to print head 120. A multiplication of this count by the average drop size gives it an approximation of the expelled ink which by subtraction from an initial ink volume gives it an approximate remaining ink level.

Figure 2:
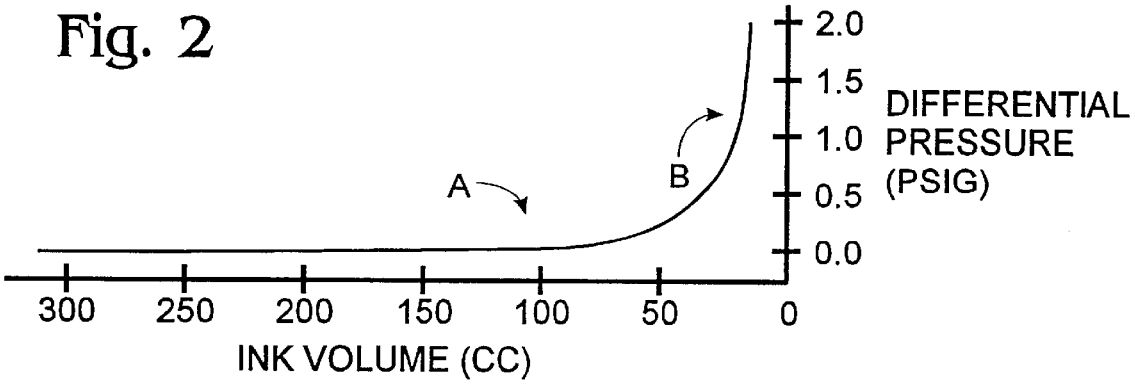
FIG. 2 is a graph of remaining ink volume verses differential supply tube pressure.

Referring to FIG. 2, a graph of ink volume verses differential supply tube pressure is shown for a 350 cc ink supply bag. It should be recognized that the parameter values at which an almost out-of-ink and an out-of-ink condition (point A and point B, respectively) are declared will vary depending on the initial volume of ink in bag 114. For example, for a 700 cc bag, point A (almost out-of-ink) occurs at approximately 200 cc.

The graph of FIG. 2 was empirically determined and found to be consistently reproducible for a 350 cc ink bag. For a substantial part of the ink supply life, pressure in ink supply tube 122 is approximately equal to the air pressure supplied on tube 113 (gravity being compensated for), thus the differential pressure is approximately zero. As the volume of ink in bag 114 falls below approximately 100 cc, the pressure in ink supply tube 122 begins to decrease (thus causing a similar increase in differential pressure). Stated conversely, decreases in pressure within tube 122 after point A are indicative of a reduction of the ink volume level within bag 114. The relationship between remaining ink and ink tube pressure is sufficiently predictable to establish an accurate approximation of the remaining ink volume based on a measured pressure. Thus, the readings taken by pressure sensor 131 or the like are indicative of remaining ink volume.

Referring again to FIG. 1, the preferred operation of arrangement 110 is generally as follows. When the print head is not printing, i.e., during a printing pause, sensor 131 is prompted to take a reading. Readings are taken during printer pauses because the dynamic pressure losses that occur during printing would prevent accurate comparison of measured pressure with the standard pressure curve (shown in FIG. 2). Upon the detection of an almost out-of-ink condition, detected as the initial pressure drop at approximately 100 cc, air pressure to supply 112 may be increased. The increased air pressure assures that adequate pressure is provided within bag 114 and tube 122 to maintain print quality and avoid a dry fire.

When the differential pressure measured by sensor 131 decreases below an established threshold level, for example 1.2 PSIG for a 350 cc ink supply bag, an out-of-ink condition is declared by control circuit 140. The actual threshold for an out-of-ink condition level may be determined empirically and may vary depending on initial ink volume as noted above and on the layout of a particular printer.

In a preferred embodiment to maximize ink utilization, drop counting mechanism 141 or a like low volume ink level measuring device is utilized after the pressure based out-of-ink condition (point B) has been declared. Use of a drop counting mechanism or the like is preferred to measure very low ink volumes because ink drop counting can be undertaken during printing (whereas pressure based readings are taken during printing pauses). Thus, the pressure based out-of-ink signal that invokes drop counting is preferably generated when it is probable that the ink supply might expire before the next printing pause.

Drop counting mechanism 141 could also be used to determine an approximate ink volume before pressure sensor 131 detects an almost out-of-ink condition. Control circuit 140 provides control for processing circuit 134 and drop counting mechanism 141. This combination of drop counting and ink pressure based volume detection provides an accurate and economical manner of detecting ink volume throughout the useful life of an ink supply.

Figure 3:
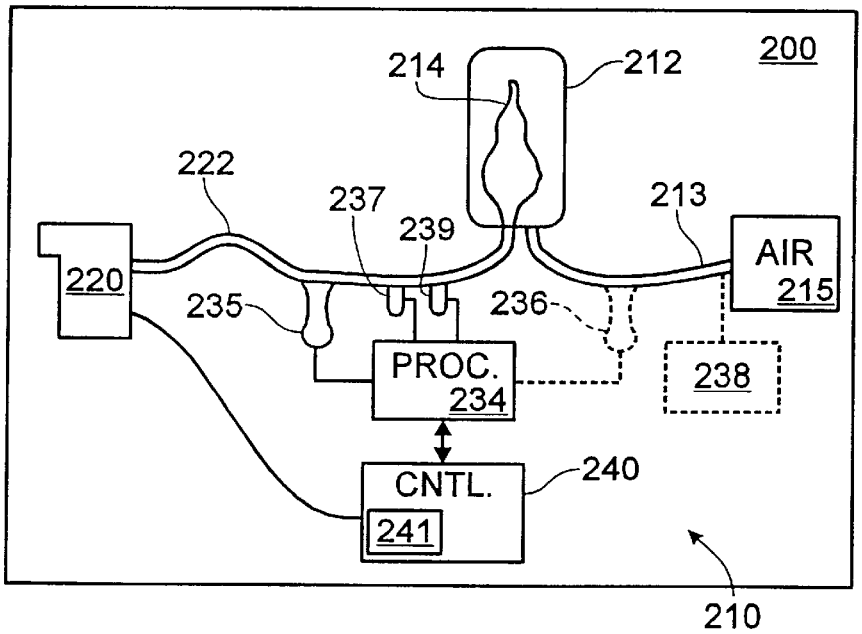
FIG. 3 is a diagram of alternative ink level detecting arrangements in accordance with the present invention.

Referring to FIG. 3, a diagram of a printer 200 having an alternative ink level detecting arrangement 210 in accordance with the present invention is shown. The printer of FIG. 3 utilizes much of the same componentry of the embodiment of FIG. 1. Like components have their hundreds unit replaced with the number 2 in FIG. 3. FIG. 3 illustrates one embodiment in which two absolute or gauge pressure sensors 235, 236 are utilized instead of a differential pressure sensor. A difference signal is generated in circuit 234 from the two sensor output signals and that signal is treated in a manner similar to the output signal of differential pressure transducer 131. In another embodiment, absolute pressure transducer 236 is replaced with a pressure regulator 238 that assures that the air pressure delivered to bag 214 remains constant. In this embodiment, the output of absolute pressure transducer 235 could be compared to the constant air pressure reference signal. It should also be recognized that in place of a pressure transducer, a pressure switch may be utilized. While pressure transducers measure a continual pressure change, pressure switches output an on or off signal based on whether the measured pressure is above or below an established threshold. A plurality of pressure switches could be coupled to ink supply tube 122, for example, one that detects an almost out-of-ink condition (237) and one that detects an out-of-ink condition (238). In all embodiments of the invention, pressure of the ink may be detected either directly at the outlet port of the ink container, or at some other point in the ink delivery system having a known pressure relationship with the outlet port, and thus substantially equivalent to the pressure at the outlet port.

Figure 4:
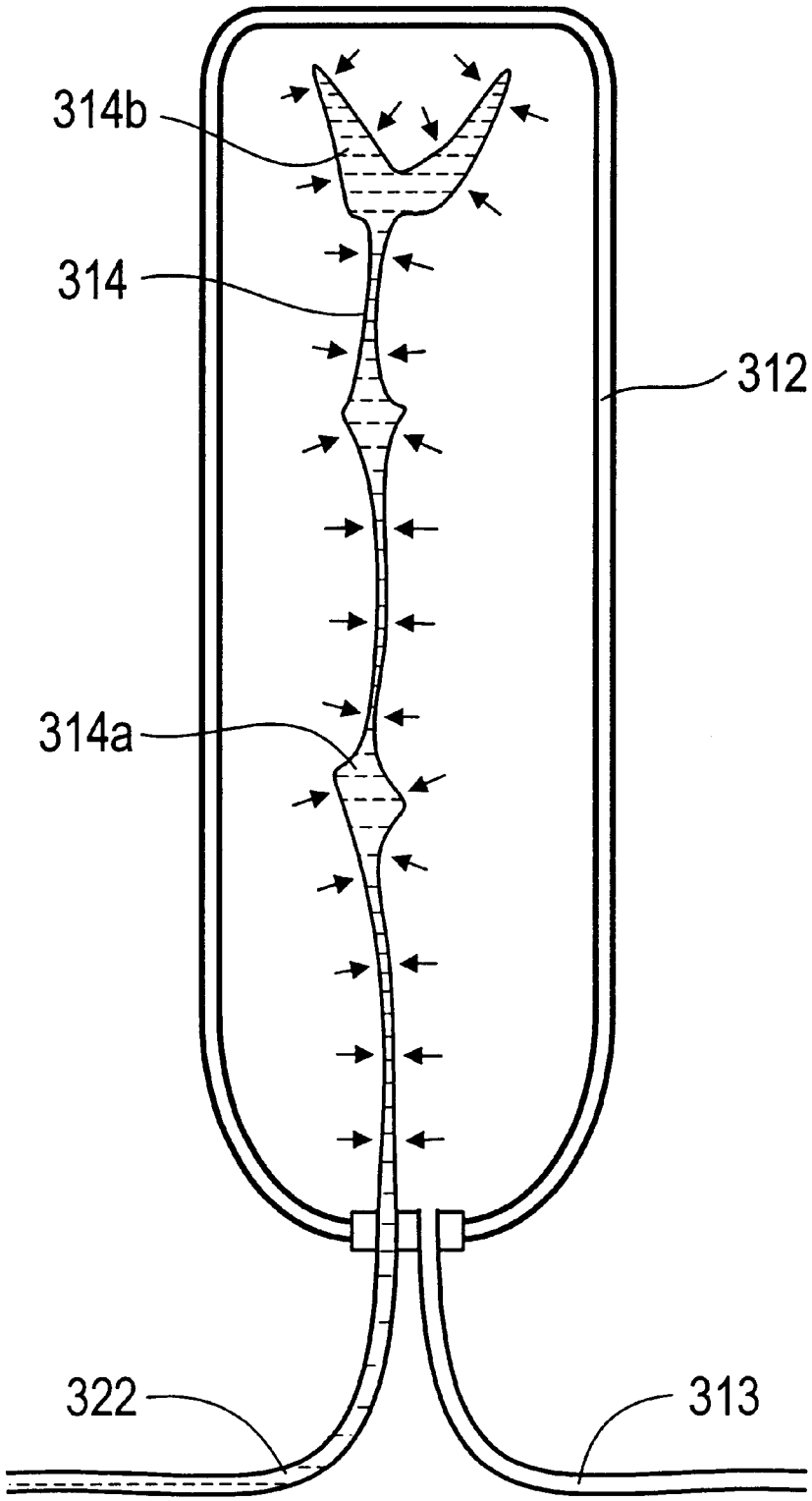
FIG. 4 illustrates how the collapse of an internal bag member in an ink supply as the supply is exhausted results in an increased pressure differential.

FIG. 4 illustrates one manner in which an enhanced pressure differential may be created as an ink supply is emptied. The ink supply comprises a supply container pressure vessel 312 and an internal bag 314. Air pressure enters the container through tube 313, and ink is expelled through tube 322. FIG. 4 shows the bag with only a small quantity of ink remaining.

Rather than collapsing in a perfectly flat shape, large wrinkles, such as indicated at 314*a* and 314*b*, appear on the bag. The wrinkles trap pockets of ink. As ink is forced out of the bag by air pressure, the wrinkles become increasingly more difficult to collapse with air pressure. Downstream of the supply, this effect is detectable as an increasing and predictable pressure drop, such as shown in FIG. 2.

The effect may also be used to detect and quantify a near out-of-ink condition in a non-pressurized ink delivery system, such as may be implemented in a low-cost printer system. For example, tube 313 in FIG. 4 may be open to the ambient atmosphere, or the container pressure vessel 312 may have other openings to the ambient atmosphere (not shown), or the pressure container may be dispensed with entirely (not shown). The pressure driving the ink from the container to the printhead may be provided primarily by gravity effects, or by the backpressure provided by the printhead, or a combination of the two. The pressure drop provided by the resistance of a near-empty bag to further removal of ink still provides a detectable and quantifiable which may be used to provide an out of ink indication.

While the invention has been described in connection with specific embodiments thereof, it will be understood that it is capable of further modification, and this application is intended to cover any variations, uses, or adaptations of the invention following, in general, the principles of the invention and including such departures from the present disclosure as come within known or customary practice in the art to which the invention pertains and as may be applied to the essential features hereinbefore set forth, and as fall within the scope of the invention and the limits of the appended claims.

What is claimed is:

1. A printing apparatus, comprising:

an ink supply having an outer pressure vessel and an internal flexible bag for containing ink, the internal flexible bag having an output port;

a mechanism that applies pressure to said pressure vessel of the ink supply to cause ink to be expelled from said flexible bag;

a print head coupled to said ink supply;

a mechanism that generates a difference signal that is indicative of a pressure difference between the pressure applied by said pressure applying mechanism and the pressure of ink substantially at said flexible bag output port.

2. The apparatus of claim 1, further comprising logic that determines an approximate volume of ink in said ink supply based on said generated difference signal.

3. The apparatus of claim 1, wherein said ink supply is releasably coupled to said print head.

4. The apparatus of claim 1, wherein said ink supply is releasably coupled to said pressure applying mechanism.

5. The apparatus of claim 1, wherein said difference signal generating mechanism is a differential pressure sensor.

6. The apparatus of claim 5, wherein said difference signal is generated from a comparison of the output of a first absolute pressure sensor with a reference signal.

7. The apparatus of claim 1, further comprising:

a drop counting mechanism that determines an approximate volume of ink in said supply based on a volume of ink expelled from said print head; and wherein said drop counting mechanism operates at least before or after an effective period of operation of said difference signal generating mechanism.

8. A method for monitoring ink level in an ink supply for a printer, the ink supply having an outer pressure vessel and an internal bag for containing ink, the internal bag having an ink output port, comprising the steps of:

applying pressure to the outer pressure vessel of the ink supply to expel ink from the internal bag for containing ink;

measuring, substantially at said output port, the pressure of ink expelled from said ink supply;

measuring the pressure applied to said ink supply to cause the ink to be expelled;

generating a difference signal that is indicative of the difference in pressure between the applied pressure and the measured ink pressure; and determining an approximate ink level based on said difference signal.

9. The method of claim 8, further comprising the step of:

determining an approximate volume of ink in said ink supply by counting ink drops expelled from a print head to which said ink supply is coupled.

10. A printing apparatus, comprising:

an ink supply having a flexible bag for containing ink, the flexible bag having an ink outlet port and an outer surface exposed at least in part to air at an ambient atmospheric pressure;

a print head coupled to said ink supply;

a mechanism that generates a difference signal that is indicative of a pressure difference between ambient atmospheric pressure and the pressure of ink substantially at said outlet port of said flexible bag.

11. The apparatus of claim 10, further comprising logic that determines an approximate volume of ink in said ink supply based on said generated difference signal.

12. The apparatus of claim 10, wherein said ink supply is releasably coupled to said print head.

13. The apparatus of claim 10, wherein said difference signal generating mechanism is a differential pressure sensor.

14. The apparatus of claim 13, wherein said difference signal is generated from a comparison of the output of a first absolute pressure sensor with a reference signal.

15. The apparatus of claim 10 further comprising:

a drop counting mechanism that determines an approximate volume of ink in said supply based on a volume of ink expelled from said print head; and wherein said drop counting mechanism operates at least before or after an effective period of operation of said difference signal generating mechanism.

16. A method for monitoring ink level in an ink supply for a printer, the ink supply having a flexible bag for containing ink, the flexible bag having an ink outlet port and an outer surface exposed at least in part to air at an ambient atmospheric pressure, comprising the steps of:

measuring, substantially at said outlet port, the pressure relative to ambient of ink expelled from said ink supply;

generating a signal that is indicative of the difference in pressure between ambient atmospheric pressure and the measured ink pressure; and determining an approximate ink level based on said difference signal.

17. The method of claim 16, further comprising the step of:

determining an approximate volume of ink in said ink supply by counting ink drops expelled from a print head to which said ink supply is coupled.

* * * * *